US006244347B1

(12) United States Patent
Watkins

(10) Patent No.: US 6,244,347 B1
(45) Date of Patent: Jun. 12, 2001

(54) SUBSEA WELL DRILLING AND/OR COMPLETION APPARATUS

(75) Inventor: Bruce J. Watkins, Houston, TX (US)

(73) Assignee: Dril-Quip, Inc., Houston, TX (US)

( * ) Notice: Subject to any disclaimer, the term of this patent is extended or adjusted under 35 U.S.C. 154(b) by 0 days.

(21) Appl. No.: 09/364,920

(22) Filed: Jul. 29, 1999

(51) Int. Cl.[7] ..... E21B 7/12
(52) U.S. Cl. ..... 166/350; 175/8; 405/204
(58) Field of Search ..... 166/350, 355, 166/345; 175/7, 8, 5; 405/205, 210, 224, 204

(56) References Cited

U.S. PATENT DOCUMENTS

| | | |
|---|---|---|
| 2,777,669 | 1/1957 | Willis et al. . |
| 3,299,846 | 1/1967 | Jarlan . |
| 3,360,810 | 1/1968 | Busking . |
| 3,470,838 | 10/1969 | Daniell . |
| 3,572,041 | 3/1971 | Graaf . |
| 3,648,638 | 3/1972 | Blenkarn . |
| 3,760,875 | 9/1973 | Busking . |
| 3,778,854 | 12/1973 | Chow . |
| 3,780,685 | 12/1973 | Horton . |
| 3,824,943 | 7/1974 | Mo . |
| 3,889,476 | 6/1975 | Gerin . |
| 3,903,705 | 9/1975 | Beck et al. . |
| 3,921,557 | 11/1975 | Kapteijn et al. . |
| 3,934,528 | 1/1976 | Horton et al. . |
| 3,949,693 | 4/1976 | Bauer et al. . |
| 3,953,905 | 5/1976 | Paitson . |
| 4,004,531 | 1/1977 | Mott . |
| 4,033,277 | 7/1977 | Schaper . |
| 4,098,333 | 7/1978 | Wells et al. . |
| 4,167,279 | 9/1979 | Lucksinger . |
| 4,181,453 | 1/1980 | Vache . |
| 4,185,694 | 1/1980 | Horton . |
| 4,212,561 | 7/1980 | Wipkink . |
| 4,286,665 | 9/1981 | Walker . |
| 4,372,706 | 2/1983 | Young . |
| 4,423,982 | 1/1984 | Zaremba . |
| 4,428,702 | 1/1984 | Abbott et al. . |
| 4,462,717 | 7/1984 | Falcimaigne . |
| 4,473,323 | 9/1984 | Gregory . |
| 4,502,551 | 3/1985 | Rule et al. . |
| 4,606,673 | 8/1986 | Daniell . |
| 4,648,848 | 3/1987 | Busch . |
| 4,702,321 | 10/1987 | Horton . |
| 4,893,965 | 1/1990 | Jordan . |
| 4,913,238 | 4/1990 | Danazcko et al. . |
| 4,934,871 | 6/1990 | Kazokas, Jr. . |
| 4,966,495 | 10/1990 | Goldman . |
| 4,995,762 | 2/1991 | Goldman . |
| 5,007,482 | 4/1991 | Forsyth et al. . |
| 5,044,450 | 9/1991 | Aso et al. . |
| 5,122,010 | 6/1992 | Burguieres, Jr. et al. . |
| 5,150,987 | 9/1992 | White et al. . |
| 5,330,293 | 7/1994 | White et al. . |
| 5,421,676 | 6/1995 | Wybro et al. . |

(List continued on next page.)

FOREIGN PATENT DOCUMENTS

| | | |
|---|---|---|
| 2307705 A | 6/1997 | (GB) . |
| 2322886 A | 9/1998 | (GB) . |
| 2335452 A | 9/1999 | (GB) . |
| WO 00/48899 | 8/2000 | (WO) . |

*Primary Examiner*—Frank Tsay
(74) *Attorney, Agent, or Firm*—Browning Bushman P.C.

(57) ABSTRACT

There are disclosed two embodiments of a subsea drilling, completion and/or workover apparatus which includes a spar buoy having a well therethrough, and a riser which extends through the well in the buoy for connection to the subsea wellhead during the drilling and/or completion process. A buoyancy tank is disposed about the riser within the buoy well to support the riser, and the upper end of the tank is fee to move vertically with respect to the well deck so that it will not be placed in compression despite anticipated rise and fall of the buoyancy tank.

11 Claims, 9 Drawing Sheets

U.S. PATENT DOCUMENTS

| | | |
|---|---|---|
| 5,431,511 | 7/1995 | Guy . |
| 5,439,060 | 8/1995 | Huete et al. . |
| 5,439,321 | 8/1995 | Hunter . |
| 5,447,392 | 9/1995 | Marshall . |
| 5,479,990 | 1/1996 | Peppel . |
| 5,480,265 | 1/1996 | Marshall et al. . |
| 5,480,266 | 1/1996 | Marshall et al. . |
| 5,551,802 | 9/1996 | Wybro . |
| 5,558,467 | 9/1996 | Horton . |
| 5,584,607 | 12/1996 | de Bahn . |
| 5,609,442 | 3/1997 | Horton . |
| 5,639,187 | 6/1997 | Mungall et al. . |
| 5,642,966 | 7/1997 | Morrison et al. . |

SUBSEA WELL DRILLING AND/OR COMPLETION APPARATUS

FIELD OF THE INVENTION

This invention relates generally to apparatus for use in the drilling, completion and/or workover of a subsea well from a spar buoy at the sea level above the well. More particularly, it relates to apparatus of this type having an improved riser system which extends through a well in the spar buoy.

Spar buoys are caissons of such vertical length as to extend within relatively quiescent areas of the ocean. They have a well through which a riser extends from the platform at the upper end of the buoy for connection at their lower ends to the subsea well.

During a drilling process, a bit on the lower end of a string of drill pipe is lowered into and raised from the well through the riser, with drilling mud circulated downwardly through the bit being returned to the drill ship through the annulus between the drill string and the riser. During a completion or workover process, the drilling riser is replaced by a completion riser through which tubing and casing strings may be run for installation within the bore of the well.

DESCRIPTION OF RELATED ART

According to U.S. Pat. No. 4,702,321, it has been proposed to support the weight of the riser pipes by means of buoyancy units, usually air filled tanks which surround the riser to support it within the well of the spar buoy. In this way, the tanks as well as the upper portions of the risers enjoy the protection afforded within the well by the buoy passageway.

As shown in such patent, however, the tanks connect to the platform, so that, although the risers are maintained in tension, the tanks are in compression. This of course subjects the tanks to buckling, and for this reason, the riser system includes several intermediate decks within the well through which the tanks are guideably received to counter their tendency to buckle.

SUMMARY OF THE INVENTION

It is the object of this invention to provide apparatus of this type in which the riser system is of such construction as to minimize compression in the buoyancy tanks and thereby, among other things, alleviate the need for their lateral stability within the well of the spar buoy.

This and other objects are accomplished, in accordance with the illustrated embodiments of the invention, by subsea drilling, completion and/or workover apparatus which comprises a spar buoy having a well deck and; as in the Horton patent, a riser system which includes a riser which extends through the well of the buoy to the subsea well during drilling and/or completion of the well, and one or more buoyancy tanks formed between inner and outer walls disposed about the risers for supporting them. More particularly, the inner wall of the tank has a shoulder on which the riser is landed, and the riser is free to move vertically with respect to the well deck of the platform so that the tank is not placed in compression other than that due to its weight. As shown in the illustrated embodiments of the invention the shoulder may be adjacent the lower or upper end of the inner wall or positions between them. Also, a tubular extension on the upper end of the tank may surround a downward extension of the deck for guided vertical reciprocation with respect thereto.

For this purpose, and as shown in the preferred embodiments of the invention, the inner wall or the tank has an upwardly facing seat on which a downwardly facing shoulder about the riser is supported. More particularly, the riser shoulder is formed on an outward enlargement which is closely received within the inner wall to space the riser therefrom.

Supporting the stem of the riser on a shoulder near the upper end of the inner wall of the can will of course reduce the length of it which must be stabilized, and further facilitates access to its upper end for test purposes. On the other hand, if supported on a shoulder near the lower end of the inner wall of the tank, the riser stem is more accessible for repair or replacement. In either case, or even when the riser stem is more centrally supported, compression in the tank is minimized.

The spar buoy also has at least one deck across its well having an opening through which the tank is guideably received intermediate its upper and lower ends. As illustrated, the deck opening and tank preferably have vertically interfitting parts to prevent relative rotation between them.

As also illustrated, there may be a plurality of side by side risers within the well of the buoy, and a corresponding number of tanks, with each riser extending through and supported within each tank being freely moveable vertically with respect to the well deck so that, as previously described, compression in each is minimized.

BRIEF DESCRIPTION OF THE DRAWINGS

In the drawings, wherein like reference characters are used throughout to designated like parts:

FIG. 1C showing the lower open end of the tank on which the riser stem is supported; and FIG. 1D showing the extension of the lower end of the drill string beneath the tank for connection to the subsurface wellhead;

DESCRIPTION OF PREFERRED EMBODIMENTS

Referring now to the details of the drawings, and particularly the upper end of the first embodiment of the apparatus shown in FIGS. 1A to 1D, a surface wellhead is shown, in the production mode in which a tree 10 is mounted on and extends through the well deck 11 of an offshore platform. The deck is mounted on and disposed above the upper end of the well 13 of the spar buoy indicated generally at 12.

Figure 2A:
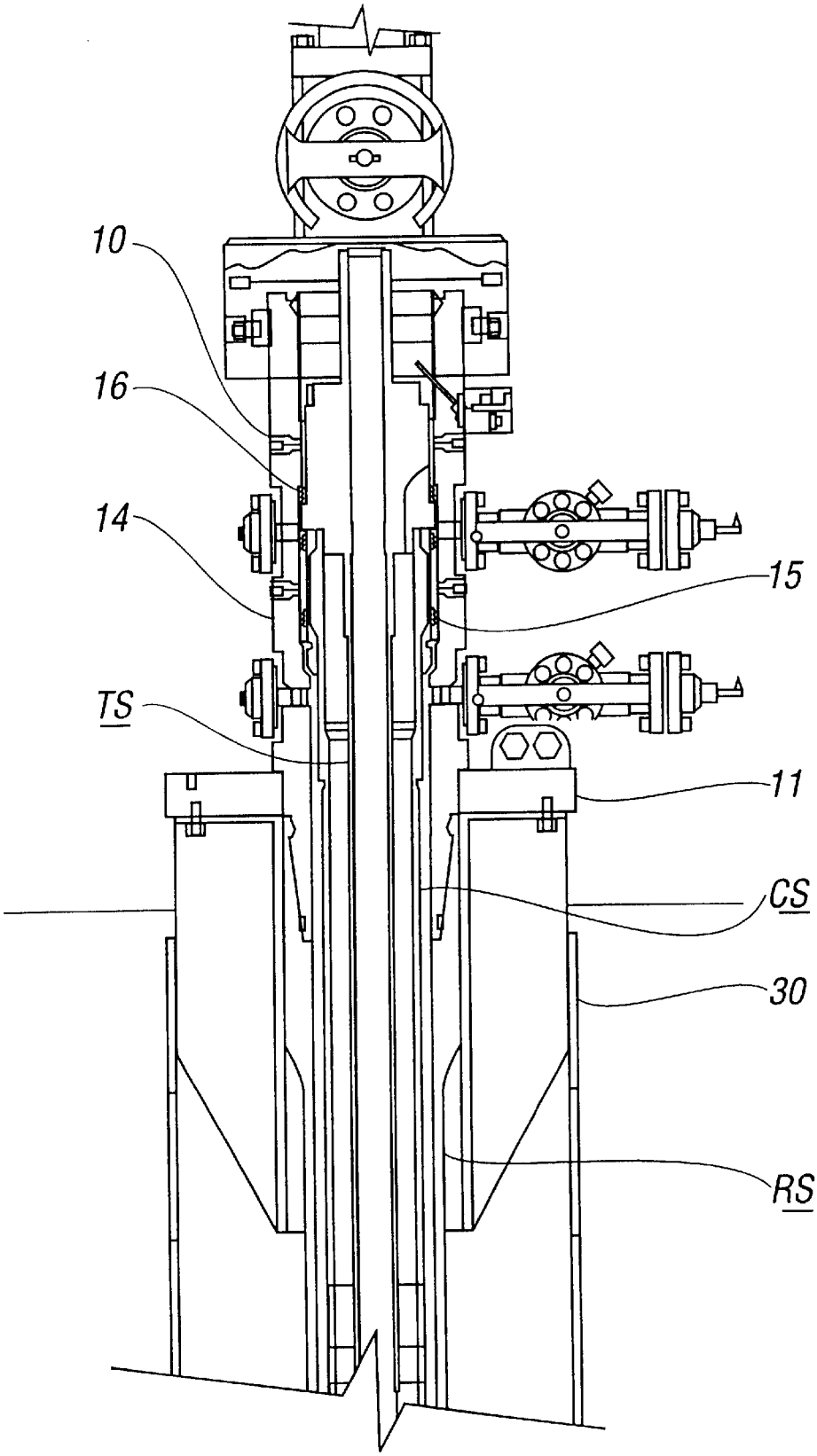
FIG. 2A is an enlarged vertical sectional view of the surface tree and upper sleeve extension shown in FIG. 1A.
Figure 3:
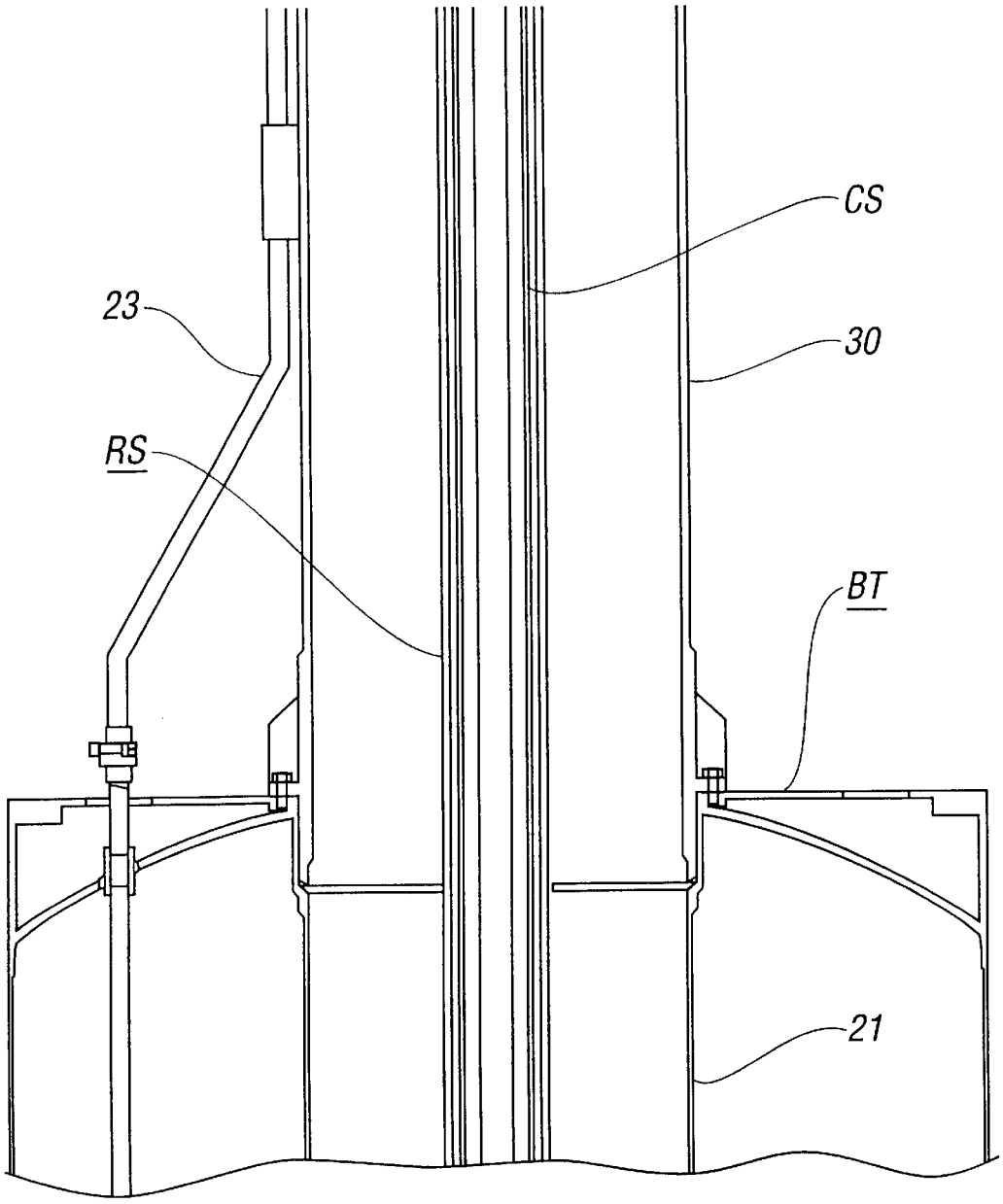
FIG. 3 is an enlarged vertical sectional view of the connection of the closed upper end of the tank an a tube through which air is supplied thereto, as shown in the upper portion of FIG. 1B.

As well known in the art, and best shown in FIG. 2A, the surface tree 10 includes a housing 14 extending through the well deck and connected at its lower end to the upper end of the riser stem RS. The housing has a bore with a shoulder on which the casing hanger 15 is mounted for suspending a casing string extending downwardly through the riser stem at the lower end of the housing into the subsea well subsea well head (FIG. 1D), as well as a tubing hanger 16 which is in turn supported on the upper end of the casing hanger for suspending it within the casing string.

As well known in the art, an outer annulus is formed between the casing string and the bore of the housing 14 and riser stem suspended therefrom, while an inner annulus is formed between the casing string and tubing string. During production, the well fluid flows upwardly through the tubing string and the bore of the tubing hanger from which it is suspended, and is in turn controlled by suitable valves mounted on the tree. The inner annulus is connected to ports in the side of the housing connecting with additional valves of the tree, while the outer annulus is connected to lower ports for flow through additional valving.

A buoyancy tank BT is disposed about the riser beneath the tree for guided movement vertically within the well 13 of the spar buoy in position to support the riser, as will be described in more detail to follow. Thus, the tank includes an inner wall 21 and an outer wall 22 to form an annular space between them to which air may be supplied or from which air may be exhausted through a line 23 extending downwardly from a source at the head of the well and through the closed upper end of the tank. As shown, the lower end of the annular space is open beneath the water level intermediate the upper and lower ends of the can, although, in a less preferred embodiment, the lower end may also be closed and the buoyancy of the tank totally controlled by the air pressure in the closed upper end of the tank.

A sleeve 30 extends upwardly from the upper end of the inner wall of the tank for guideably surrounding means on the well deck, which, as shown, comprises a series of gussets. More particularly, these gussets are of such height or vertical length as to ensure that the upper end of the sleeve of the tank is free to slide vertically with respect thereto in all the anticipated vertical positions of the can beneath the deck, thus avoiding placing the can in compression.

Figure 1A:
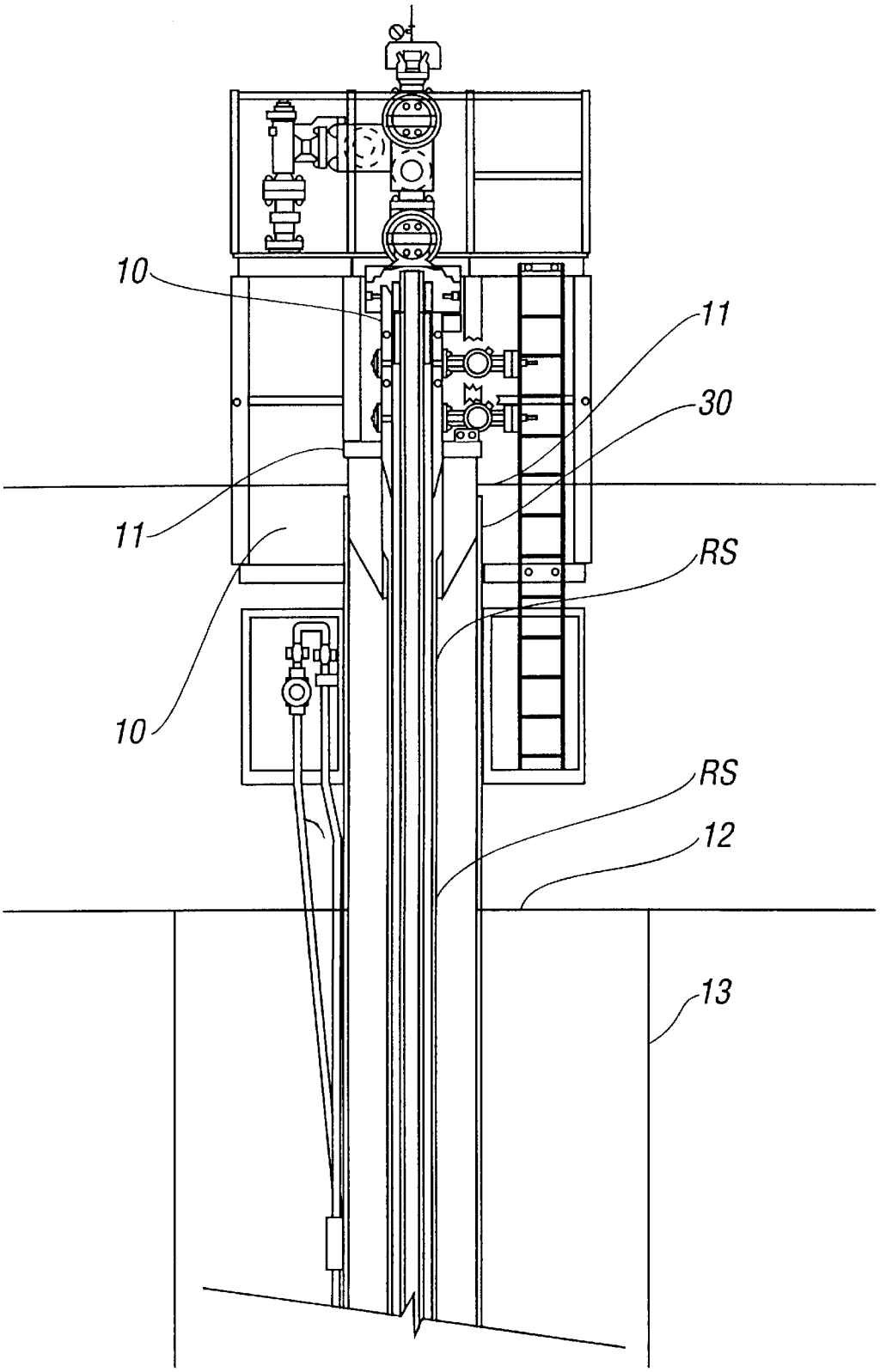
FIGS. 1A–1D are vertical sectional views of a first embodiment of the invention, with FIG. 1A showing a surface tree mounted on an offshore platform and a sleeve at the upper end of the buoyancy tank guideably disposed about a lower extension of the well deck on which the tree is mounted, FIG. 1B being discontinuous to show upper and intermediate portions of the tank.
Figure 1B:
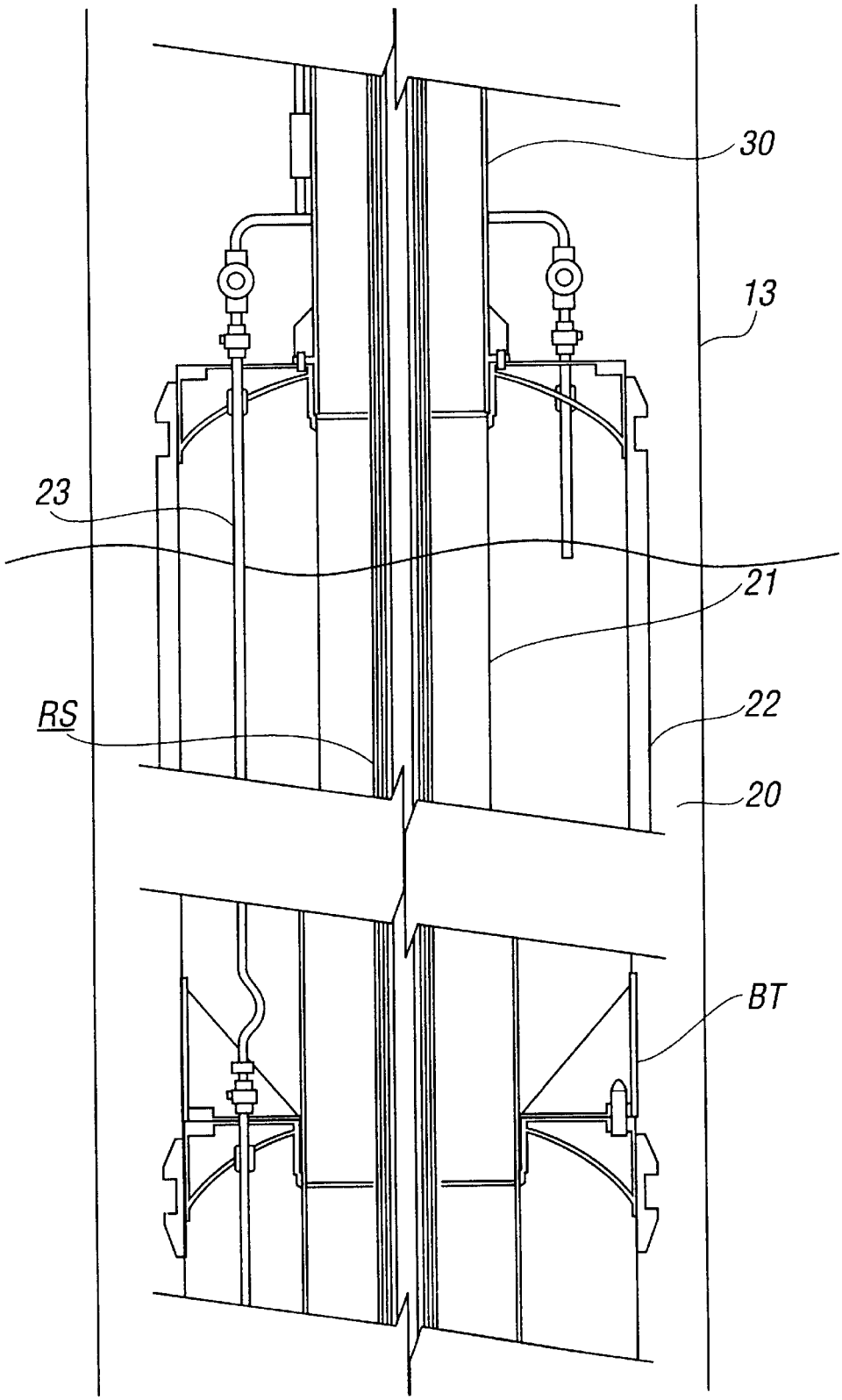
Figure 1C:
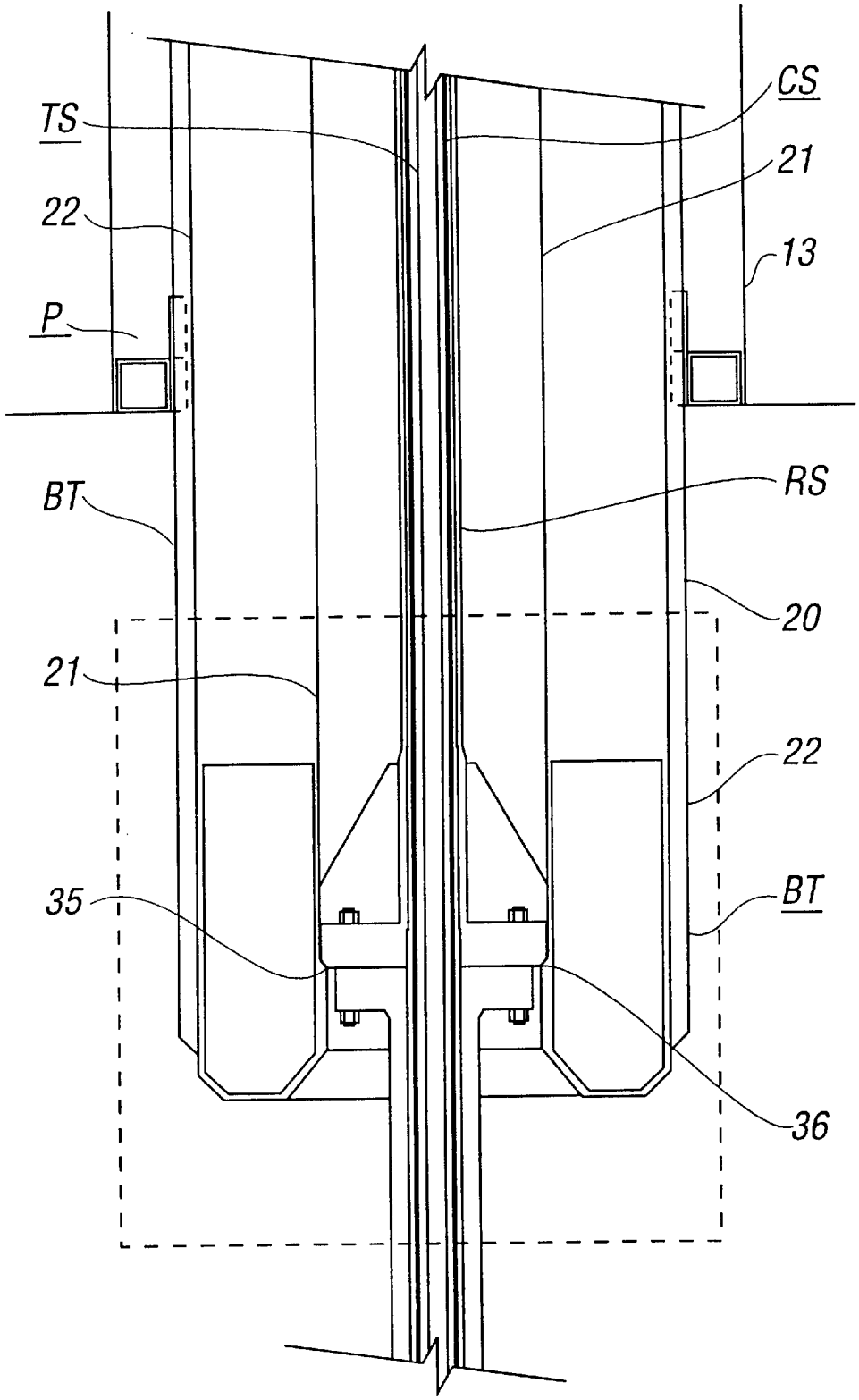
Figure 1D:
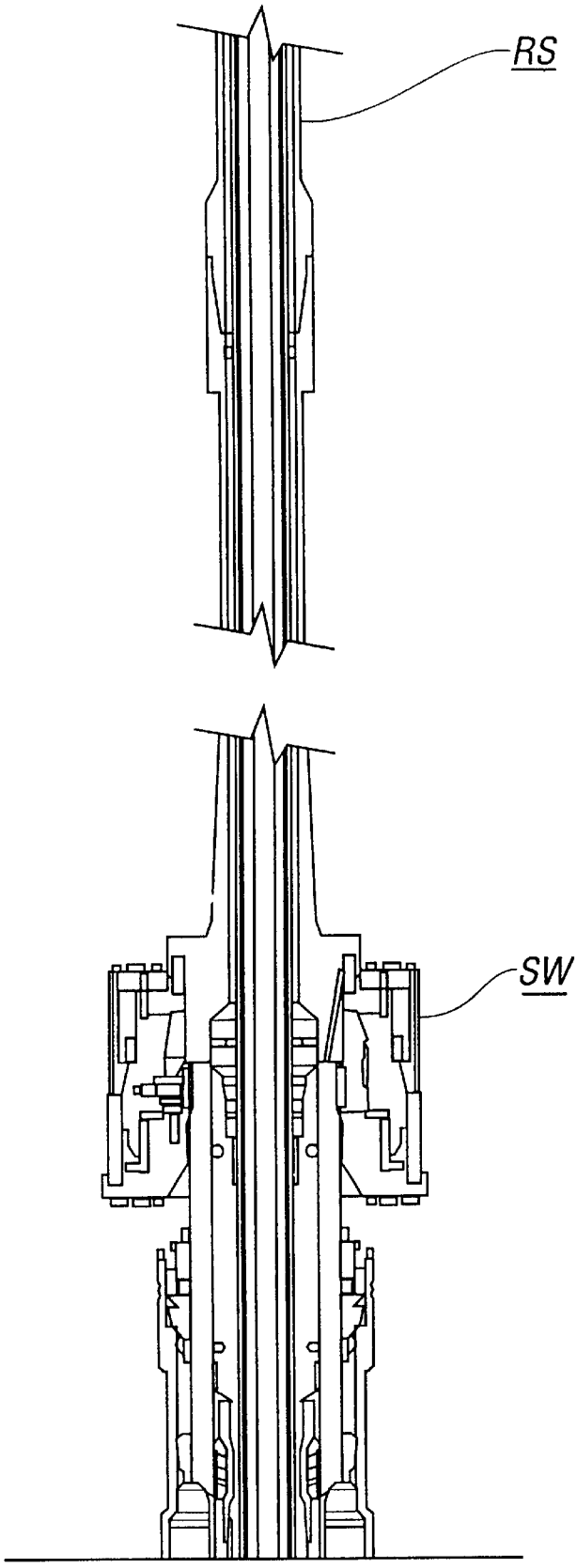

As both shown in FIG. 1C, the lower end of the inner wall of the can has an annular seat 35 on which a downwardly facing shoulder 36 about an intermediate portion of the riser stem is mounted, thus supporting the riser from the can, but nevertheless permitting the can to rise and fall without being placed in compression. The closed upper end of the can comprises a cap, which, as shown in FIG. 1B, surrounds the lower end of the guide sleeve 30 for connection thereto by means of bolts or the like. The line 23 through which air flows to or from the interior of the tank extends sealably through a connector mounted on the cap at the upper end of the can.

As previously described, the riser is guidably received within the inner wall of the tank, as indicated by the flanges on the lower end riser stem on which shoulder 36 is found. As shown in FIG. 1C, the outer wall of the tank and the opening in the spar buoy through which it is received have vertically interfitting parts P which prevent the rotation of the can within the buoy. Also, there are gusseted flanges on the intermediate portion of the outer wall of the tank which maintain the inner and outer walls properly spaced.

Figure 5A:
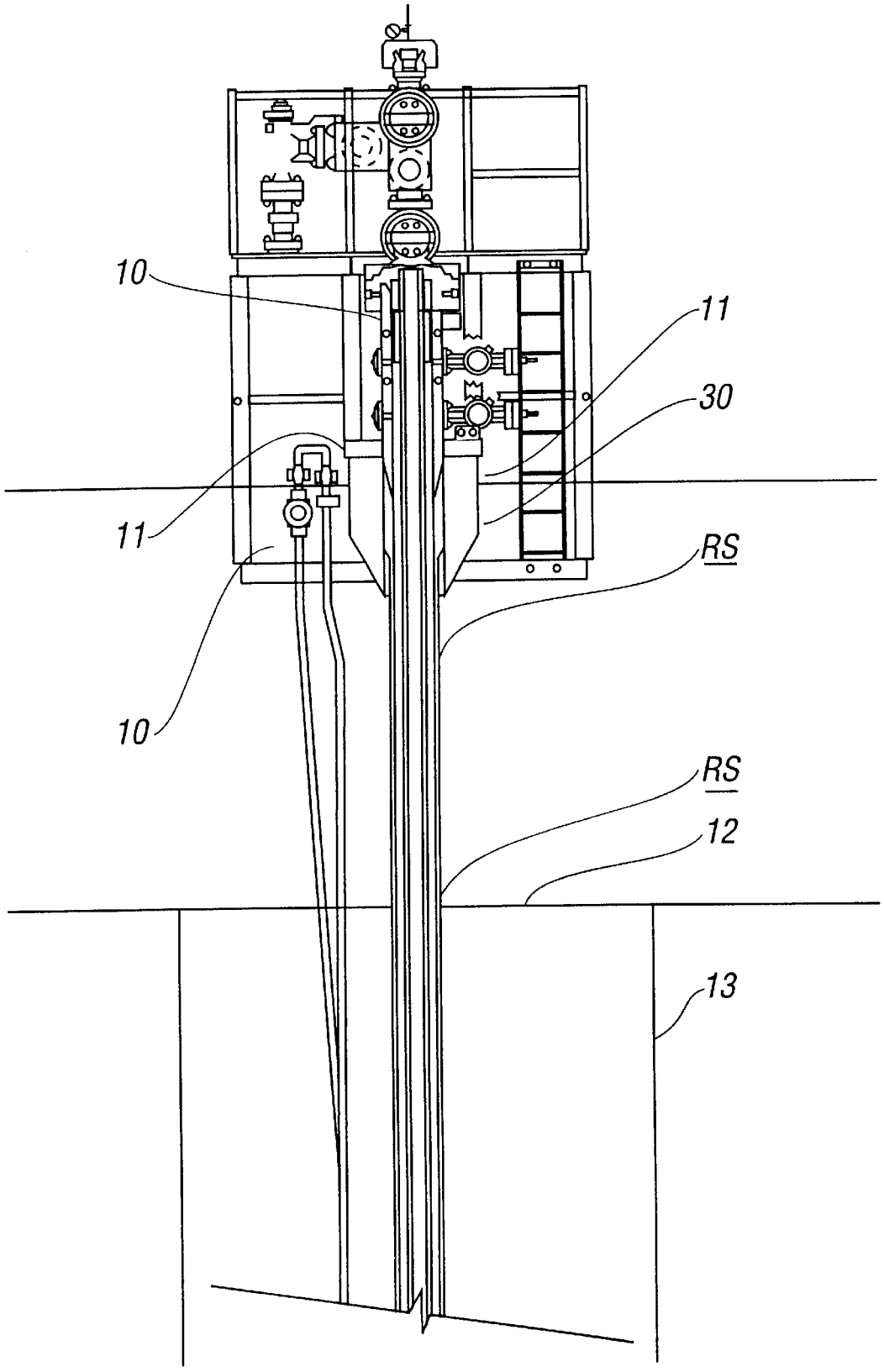
FIGS. 5A and 5B are vertical sectional views of an alternative embodiment of the invention, including a surface wellhead, as in FIG. 1A, and in which a drill string extending therethrough is supported near upper end of the inner wall of the riser.
Figure 5B:
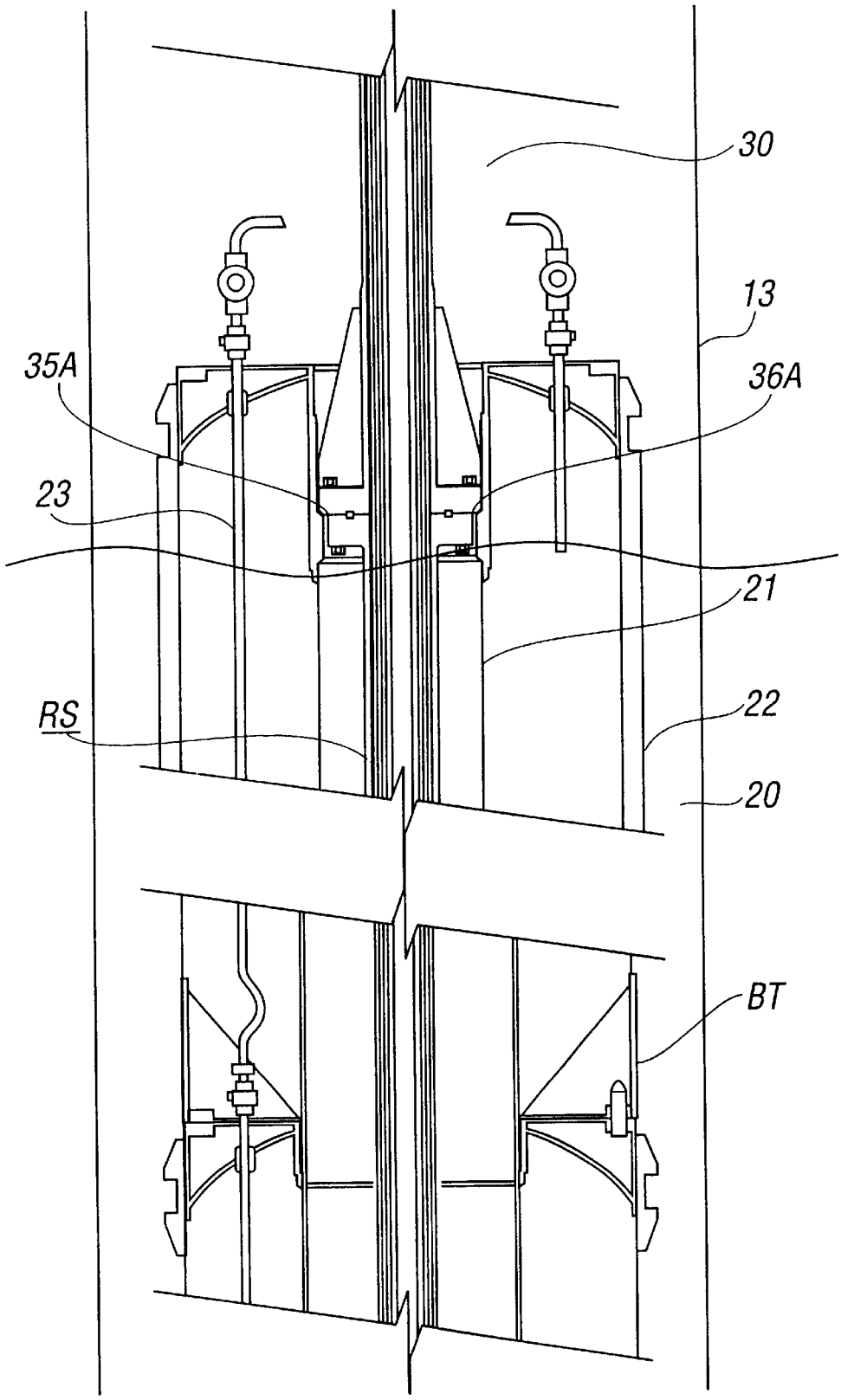

In the alternate embodiment of the invention shown in FIGS. 5A and 5B, a shoulder 35A on the riser is seated on a shoulder 36A on the inner wall of the tank near the upper end of its inner wall. In many other respects, it is similar to the first embodiment, and hence the same reference characters are used. In one respect, however, it differs in that the tank does not have an upper sleeve for guidance purposes. Thus, it contemplates the use of other conventional means used for stabilizing the riser stem to the extend required. Also, the invention of course anticipates that the supporting shoulder within the tank may be at other locations intermediate its upper and lower ends.

Figure 4:
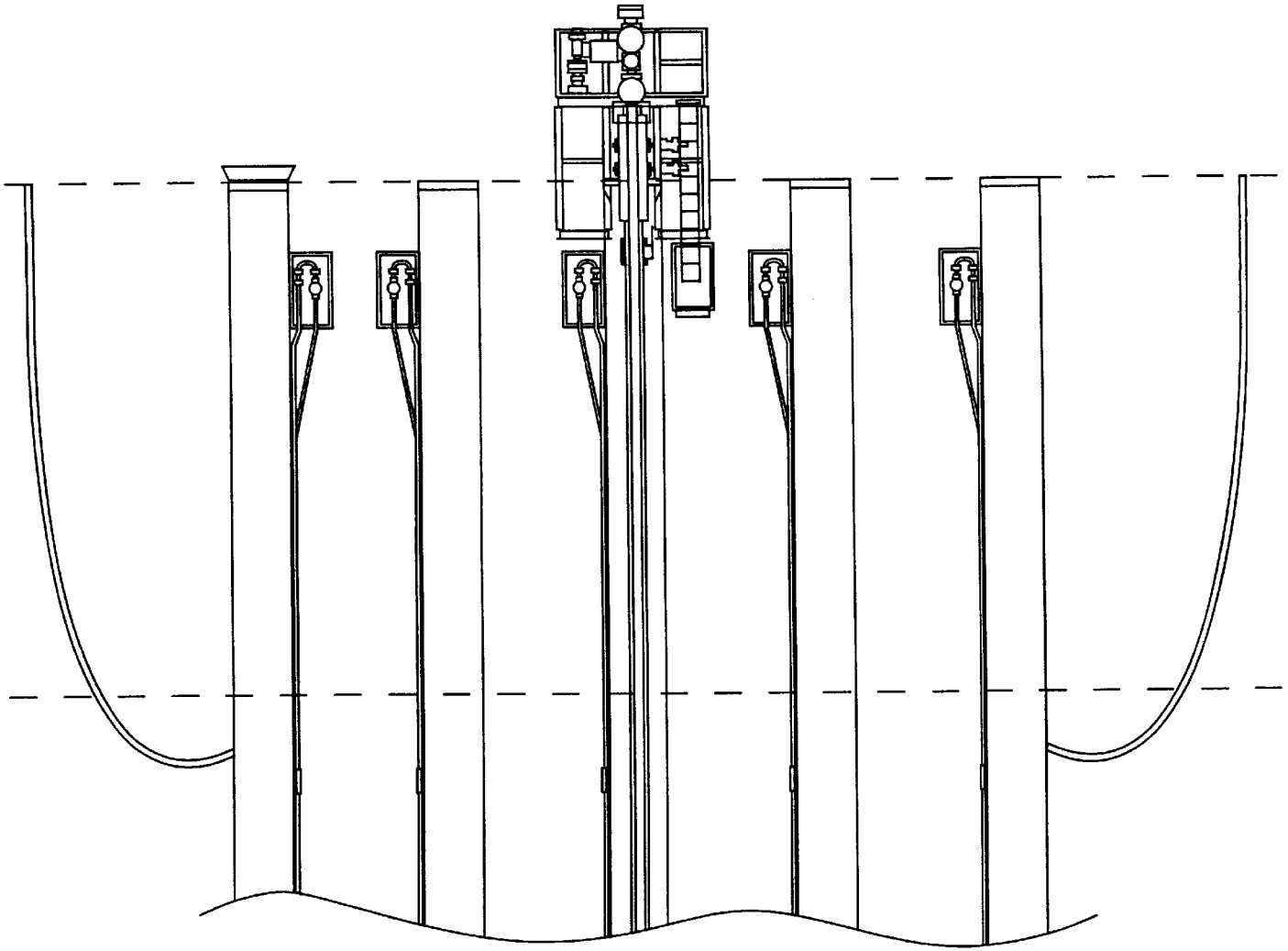
FIG. 4 is a vertical sectional views of the upper ends of guide sleeves of risers which are disposed in side by side relation within the well of the buoy, and the drill string extending within the cental riser.

As previously described, and as shown in FIG. 4, for example, the well through the spar buoy may be of such size as to permit a number of risers and buoyancy tanks to be disposed therein generally in side by side relation, but free to move vertically with respect to one another. Thus, as shown in FIG. 4, the upper end of the guide sleeve for each can extends upwardly for guided disposal about the lower end of an individual well deck. Although only one surface tree is shown mounted on one of the decks to suspend a riser therefrom for extension through a buoyancy tank, it will be understood that two or three or even more may be so disposed, thus enabling the completion of a number of wells through the single spar buoy.

In this later regard, and as well known in the art, prior to completion of the well, the subsea well may be drilled through the riser by means of drilling tools lowered through a blowout preventer mounted on the upper end thereof. Then of course, upon drilling of the well, the blowout preventer may be replaced by the surface tree to permit the completion and production from the well. These of course are procedures well known in the art.

From the foregoing it will be seen that this invention is one well adapted to attain all of the ends and objects hereinabove set forth, together with other advantages which are obvious and which are inherent to the apparatus.

It will be understood that certain features and subcombinations are of utility and my be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. Apparatus for use in drilling, completing and/or working over a subsea well, comprising:

a spar buoy having a well therethrough and a surface wellhead connected at its upper end to a deck of the buoy, a riser extending through the well for connecting the surface wellhead to the subsea well during drilling, completion and/or workover of the well, a buoyancy tank having an inner wall, and means on the inner wall for supporting the riser therefrom, the upper end of the tank being free vertically with respect to subsea wellhead.

2. As in claim 1, wherein the supporting means is near the lower end of the inner wall.

3. As in claim 1, wherein the supporting means is near the upper end of the inner wall.

4. As in claim 1, wherein the inner wall of the tank has an upper extension surrounding the surface wellhead for guided vertical reciprocation with respect thereto.

5. As in any one of claims 1 to 4, including:

at least one deck across the well in the spar buoy and having an opening through which the tank is guidably received intermediate its upper and lower ends.

6. As in claim 5, wherein:

the deck opening and tank have vertically interfitting parts to prevent relative rotation therebetween.

7. As in claim 1, wherein:

there are a plurality of side by side tanks within the buoy well.

8. As in claim 1, wherein:

the tank has a closed upper end and there is a source of air or other gas on the deck, and a line connects the gas with the tank below its upper end.

9. For use in drilling, completing and/or working over of a subsea well from a spar buoy having a well to receive a surface wellhead, an assembly comprising:

a riser pipe whose upper end is adapted to extend through the well to connect the surface wellhead to a subsurface wellhead, and a buoyancy tank disposed about the riser within the well and having an upwardly facing shoulder at its inner wall for supporting a downwardly facing shoulder on the riser pipe when so disposed.

10. As in claim 9, wherein:

the shoulder is near the lower end of the inner wall, and a tubular extension on the upper end of the inner wall of the tank surrounds the surface wellhead for vertical reciprocation with respect thereto.

11. As in 9, wherein:

the shoulder is near the upper end of the inner wall.

* * * * *